US006766560B2

(12) United States Patent
Murphy

(10) Patent No.: US 6,766,560 B2
(45) Date of Patent: Jul. 27, 2004

(54) GUTTER LEAF-BLOWER

(76) Inventor: Milford R. Murphy, 1101 Lynda La., Arlington, TX (US) 76013

( * ) Notice: Subject to any disclaimer, the term of this patent is extended or adjusted under 35 U.S.C. 154(b) by 0 days.

(21) Appl. No.: 10/313,590

(22) Filed: Dec. 9, 2002

(65) Prior Publication Data

US 2004/0107532 A1 Jun. 10, 2004

(51) Int. Cl.[7] ..... A47L 5/14
(52) U.S. Cl. ..... 15/414; 15/344; 15/405
(58) Field of Search ..... 15/414, 327.5, 15/415.1, 330, 405, 344

(56) References Cited

U.S. PATENT DOCUMENTS 3,971,098 A * 7/1976 Davis ..... 15/415.1
4,502,806 A * 3/1985 Albertson ..... 401/137
4,748,712 A * 6/1988 DiGiovanni ..... 15/327.5
5,056,187 A * 10/1991 Higgins ..... 15/339
5,195,209 A * 3/1993 Watkins ..... 15/327.5
5,584,436 A * 12/1996 Sepke ..... 239/154
5,586,360 A * 12/1996 Diederiks et al. ..... 15/414
5,813,088 A * 9/1998 Wagner et al. ..... 15/327.5
6,125,503 A * 10/2000 Callahan ..... 15/414
6,519,809 B2 * 2/2003 Gutry ..... 15/414

* cited by examiner

*Primary Examiner*—Theresa T. Snider

(57) ABSTRACT

The Gutter Leaf-Blower is an apparatus conceived to clean rain gutters. The objective is to provide the operator with a user 'friendly' means of blowing leaves out of gutters while operating from ground level. The objective was accomplished by mounting an air nozzle on one end of a small lightweight, 6–8 foot rigid tube assembly and, in turn, connecting the input of the air nozzle to the output of an air blower with a flexible air hose. This configuration offers flexibility in the it allows the operator to control the position of the air nozzle relative to the gutter with the extension tube assembly without requiring movement of the blower unit. With this approach, the user can operate from ground level and control the position of the nozzle with either hand while holding the air blower with the other hand like a suitcase. Thence, the air nozzle is remoted (within limits) from the air blower unit and can be independently positioned relative to the gutter while the user operates from ground level—"user friendly".

6 Claims, 3 Drawing Sheets

GUTTER LEAF-BLOWER

BACKGROUND OF INVENTION

The claimed invention relates to an apparatus used for cleaning rain gutters. It comprises an electrical or gasoline powered air blower, commonly used for yard work, in combination with an air nozzle extension unit. This combination is used to blow leaves and debris out of rain gutters which are normally located under the eaves of buildings. The air nozzle extension unit, in effect, remotes the air nozzle from the blower and, hence, enhances the capability of the blower in a manner such that it allows the user to operate from ground level while cleaning a rain gutter.

Prior Art

The most commonly used method to clean rain gutters is to climb a ladder, rake the leaves out, move the ladder, rake the leaves out, etc. On a low pitch roof the operator can place a ladder on the roof, climb the ladder with the air blower, and walk along the edge of the roof using the blower to clean the gutter—a degree of safety is involved here. A more modem approach that is currently being used is to replace the standard air nozzle on a blower with a long (10 ft.) rigid extension air tube. This allows the operator to work from the ground level. It does, however, add an appreciable amount of weight to the blower and is awkward to use in that it requires the operator to hold the blower in a tilted position and to move the complete assembly in all directions to control the position of the extended air nozzle. This type of an accessory is currently being marketed by STIHL and Echo for use with their respective air blowers.

SUMMARY

The objective of the claimed invention is to offer a rain gutter cleaning apparatus that is more "user friendly" than the currently used approaches. This objective was accomplished by mounting an air nozzle on one end of a small, lightweight, 6–8 foot rigid extension tube assembly and, in turn, connecting the air hose to the output if an air blower with a flexible air hose. This configuration offers flexibility in that it allows the operator to control the nozzle position relative to the gutter with the extension tube assembly without requiring movement of the blower unit. With this approach, the user can operate from ground level and control the position of the air nozzle with either hand. Also, it allows the user to hold the air blower, like a suitcase, with either hand. Thence, the air nozzle is remoted, to some degree, from the blower unit and can be independently positioned relative to the gutter while the user operates from ground level—"user friendly".

BRIEF DESCRIPTION OF SEVERAL VIEWS OF THE EQUIPMENT

DESCRIPTION OF THE INVENTION

Figure 1:
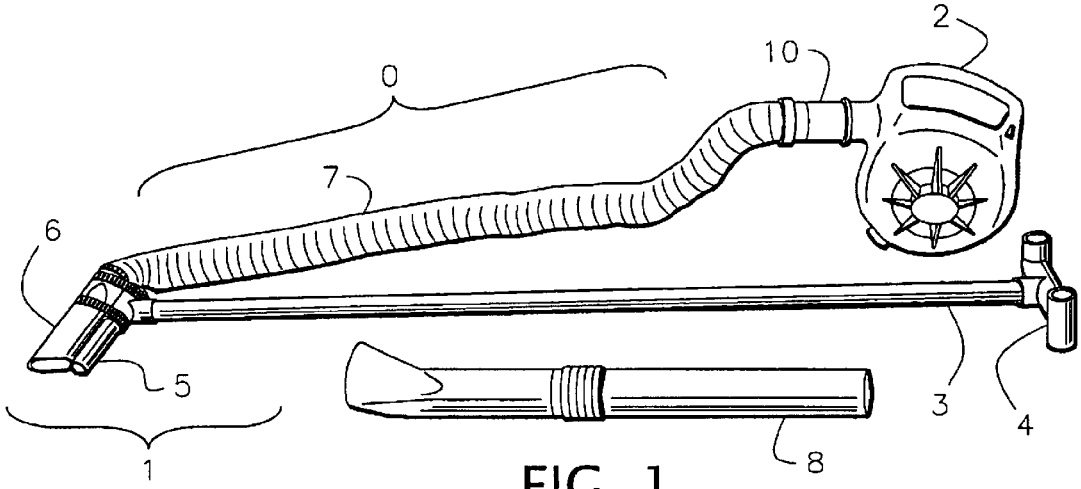
FIG. 1 is a view showing the proof-of-concept model of the Gutter Leaf-Blower and also how the gasoline powered air blower and air nozzle extension unit are combined to operate as an apparatus for cleaning rain gutters.

The proof-of-concept model of the Gutter Leaf-Blower O is shown in FIG. 1 wherein a gasoline powered air blower 2 is combined with the air nozzle extension unit 1 to provide a means of cleaning rain gutters while the user operates from ground level. As shown in FIG. 1, the air nozzle extension unit 1 consists of an elongated tube 3 with a handle 4 on one end, an air nozzle 6 on the other end, and an air hose 7 that connects the air nozzle 6 to the output of the air blower 2. The air nozzle extension unit 1 is attached to the air blower 2 simply by removing the standard air nozzle 8 and inserting the air hose adapter 10 into the output of the air blower 2.

Figure 2:
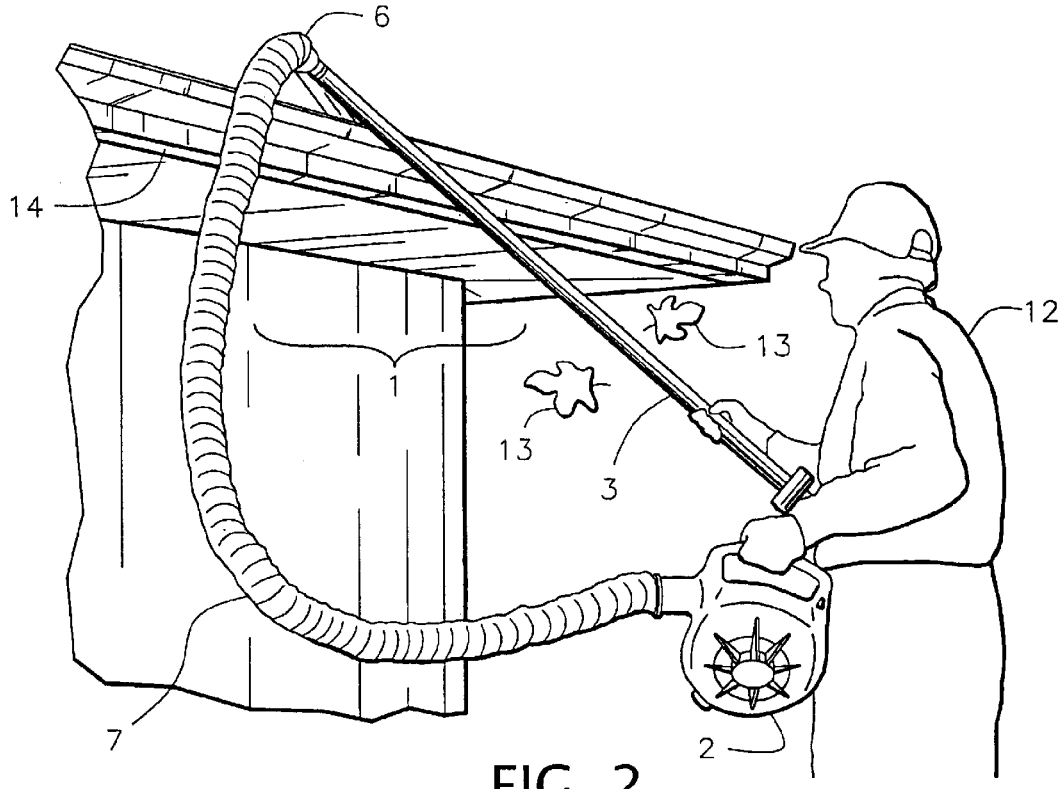
FIG. 2 is a view showing how the Gutter Leaf-Blower can be used to clean rain gutters.
Figure 3:
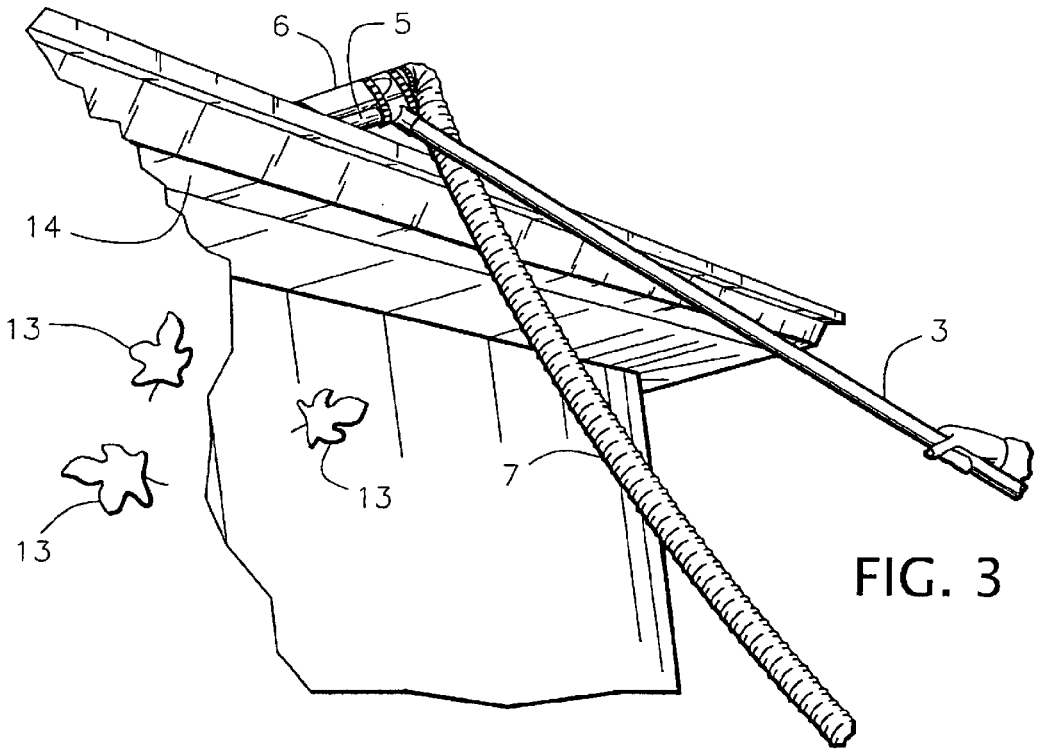
FIG. 3 is a view showing that the Gutter Leaf-Blower can be operated in the opposite direction simply by rotating the extension tube assembly 180 degrees.

The claimed invention is used as shown in FIG. 2. The user's elbow is rested on the extension tube handle 4 and the tube 3 is grasped at a comfortable distance above the handle. With the air blower 2 running, the operator simply raises the air nozzle 6 of the extension unit 1 with one hand, grasp the air blower 2 with the other hand (like a suitcase), positions the air nozzle 6 relative to the rain gutter 14, and starts blowing the leaves 13 out of the rain gutter 14. FIG. 3 shows that the Gutter Leaf-Blower O can be changed to operate in the opposite direction simply by rotating the extension tube 3 180 degrees. The change in direction does not require changing hands on the equipment or require any movement of the air blower 2.

The air blower 2 can be gasoline or electrically powered and can be purchased a an off-the-shelf item from most hardware stores. The air blower 2 used in the proof concept model is a gasoline powered blower 2 and is produced by the Homelite Company. This blower is conventional in that it consists of a housing, power unit, fan, air inlet, air outlet, and a standard air nozzle 8 connected to the air outlet that can be easily removed and replaced with the air hose adapter 10.

Figure 4:
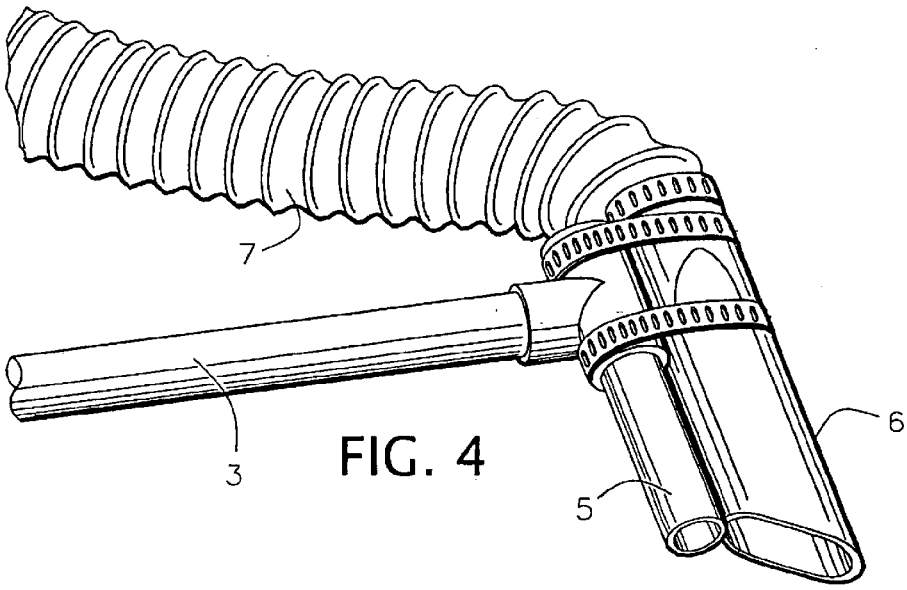
FIG. 4 is a close-up view showing the air nozzle implementation that was used in the proof-of-concept model.

The elongated extension tube 3 that was used in the proof-of-concept model was a one inch diameter PVC tube. The handle 4 on one end is an arrangement of PVC"T"s. An unbalanced PVC"T" 5 arrangement was used on the other end of the elongated extension tube 3. The air nozzle 6 used in the proof-of-concept model is an off-the-shelf nozzle that is used in shop type vacuum cleaners. FIG. 4 is a close-up view showing the air nozzle 6 clamped to the unbalanced "T" 5 arrangement.

The air hose 7 used in the proof-of-concept model is an off-the-shelf air hose used in clothes dryers to exhaust the hot air. As shown in FIG. 4, the air hose 7 is clamped to the air nozzle 6 on one end and, as shown in FIG. 1, and clamped to the air hose adapter 10 on the other end.

The air hose adapter 10 used in the proof-of-concept model was a cut-off portion of the standard air nozzle 8 shown in FIG. 1.

Figure 5:
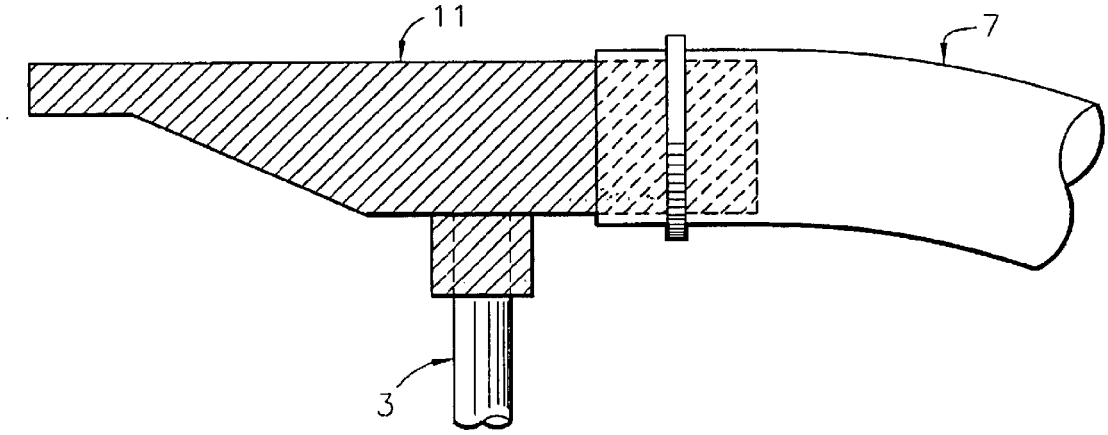
FIG. 5 is a drawing of a general configuration of a production version of the air nozzle implementation.

In production, the air nozzle 6 and the unbalanced "T" 5 arrangement would be replaced with the one element that would be similar to the air nozzle 11 shown in FIG. 5. The air hose 7 could be replaced with any durable, flexible hose. The PVC components could be replaced with any suitable plastic or lightweight metal made components in a production version.

I claim:

1. A rain gutter cleaning apparatus comprising an air blower having an air inlet and an air outlet that is connected to an air nozzle extension unit which includes an elongated lightweight tube having first and second ends, a handle mounted on said first end, nozzle inlet, having a nozzle inlet and air outlet nozzle mounted on said second end, such that the tube is located between said nozzle inlet and said nozzle outlet, and a lightweight, flexible air hose that connects at one end to said nozzle inlet to said air outlet of said air blower.

2. The apparatus as claimed in claim 1 wherein said air blower is a commercially available blower including a housing, electrical or gasoline power unit, a blower fan, the air inlet, and the air outlet which interfaces with the above said flexible air hose.

3. The apparatus as claimed in claim 1 wherein said air nozzle extension unit combines as stated with said air blower to allow for positioning said air nozzle in any direction relative to a rain gutter without requiring movement of said air blower, the user with the capability of blowing leaves and debris out of the rain gutter while operating from ground level, and thence, operational flexibility.

4. The apparatus as claimed in claim 3 wherein the one end of said lightweight, flexible air hose is connected to said nozzle air inlet and the other end connected to an adapter that, in turn, is inserted into said air outlet of said air blower, all of which results in providing independent motion between said air nozzle and said air blower.

5. The apparatus as claimed in claim 3 wherein the handle includes an "H" shaped handle to support the user's elbow while his arm is extended along the tube grasping the tube and controlling the position of said air nozzle relative to said rain gutter.

6. The apparatus as claimed in claim 3 wherein said nozzle air inlet has an outside diameter sized to fit the inside diameter of said lightweight, flexible air hose and tapers toward said nozzle air outlet that has an appreciably small air outlet diameter to effect a high velocity as is required for blowing leaves and debris from said rain gutter.

* * * * *